US011534007B2

(12) United States Patent
Spencer

(10) Patent No.: US 11,534,007 B2
(45) Date of Patent: Dec. 27, 2022

(54) CRIB LINER

(71) Applicant: James W Spencer, Clearwater, FL (US)

(72) Inventor: James W Spencer, Clearwater, FL (US)

( * ) Notice: Subject to any disclaimer, the term of this patent is extended or adjusted under 35 U.S.C. 154(b) by 0 days.

(21) Appl. No.: 16/935,358

(22) Filed: Jul. 22, 2020

(65) Prior Publication Data

US 2022/0022665 A1 Jan. 27, 2022

(51) Int. Cl.
*A47D 15/00* (2006.01)
*A47D 9/00* (2006.01)

(52) U.S. Cl.
CPC ..... *A47D 15/008* (2013.01); *A47D 9/00* (2013.01)

(58) Field of Classification Search
CPC ..... A47D 15/008; A47D 9/00
See application file for complete search history.

(56) References Cited

U.S. PATENT DOCUMENTS 2,183,828 A * 12/1939 Trubitz ..... A47C 31/11 297/224
7,213,282 B1 * 5/2007 Wojtowicz ..... A47D 15/008 5/425
8,689,379 B2 * 4/2014 Cicci ..... A47D 15/008 5/663
2003/0102342 A1 * 6/2003 Fogg ..... A45F 5/02 224/269
2011/0113552 A1 * 5/2011 Miller ..... A47D 15/008 5/424
2020/0375326 A1 * 12/2020 Aguayo ..... A45C 3/001

FOREIGN PATENT DOCUMENTS

GB 2522280 A * 7/2015 ..... A47D 15/008

* cited by examiner

*Primary Examiner* — David R Hare
*Assistant Examiner* — Adam C Ortiz
(74) *Attorney, Agent, or Firm* — DP IP Group; Franco De Liguori

(57) ABSTRACT

Crib liners configured to reduce entanglement of an infant's appendages between vertical slats of a crib, and methods for fabricating such crib liners are described. The crib liner includes a bottom layer dimensioned to cover a lower surface of a crib and a side panel formed of a breathable material extending generally perpendicular from the bottom layer. The side panel is continuous in construction such that if forms a closed circuit around the bottom layer and is configured to form a closed circuit around the perimeter of the crib and extend beyond the top surface of the crib railing. Stays are attached at intervals along an edge of the side panel. The stays are configured to hold the crib liner in place relative to the crib.

12 Claims, 6 Drawing Sheets

CRIB LINER

BACKGROUND

Technical Field

The present disclosure relates generally to crib liners, and more specifically, to a crib liner configured to reduce infant injury in a crib.

Background Information

By some estimates 10,000 children are taken to emergency rooms each year for crib rail related injuries. This number, however, does not include unreported incidents of injuries that are not severe enough to warrant an emergency room visit.

Previous attempts to prevent crib rail related injuries included crib bumpers, e.g., a cushion placed on the inside of the crib and running along the perimeter of the crib rail. However, crib bumpers have been linked to an increased risk of suffocation deaths in infants, and thus, have been banned nation-wide.

SUMMARY

An aspect of the present disclosure includes a crib liner constructed of a bottom layer dimensioned to cover a lower surface of a crib having a crib railing, and a side panel extending generally perpendicular from the bottom layer. The side panel is continuous in construction such that it forms a closed circuit around the bottom layer. By this construction, when it is applied to the crib, the side panel is configured to form a closed circuit around the perimeter of the crib and extend beyond the top surface of the crib railing. The side panel can be formed of a breathable material. Additionally, the crib liner includes stays attached at intervals along an edge of the side panel. The stays are configured to hold the crib liner in place relative to the crib.

Another aspect of the present disclosure includes a crib liner constructed of a bottom layer dimensioned to cover a lower surface of a crib having a crib railing, and a side panel extending generally perpendicular from the bottom layer. The bottom layer can be configured to envelope a mattress within a pocket formed by the bottom layer. The side panel is continuous in construction such that it forms a closed circuit around the bottom layer. By this construction, when it is applied to the crib, the side panel is configured to form a closed circuit around the perimeter of the crib and extend beyond the top surface of the crib railing. The side panel can be formed of a breathable material. Additionally, the crib liner includes stays attached at intervals along an edge of the side panel. The stays can be configured to hold the crib liner in place.

Yet another aspect of the present disclosure includes a method for constructing a crib liner. The method includes forming a bottom layer from a fabric. The bottom layer is dimensioned to cover a bottom surface of a crib. Additionally, a side panel constructed of a micro mesh fabric is arranged around the perimeter of the bottom layer. The side panel is joined to the bottom layer. A first side of the side panel is joined to a second side of the side panel to form a closed circuit around the bottom layer.

BRIEF DESCRIPTION OF THE DRAWINGS

These and other features, aspects and advantages of the present disclosure will become better understood with regard to the following description, appended claims and accompanying drawings.

DETAILED DESCRIPTION

Figure 1:
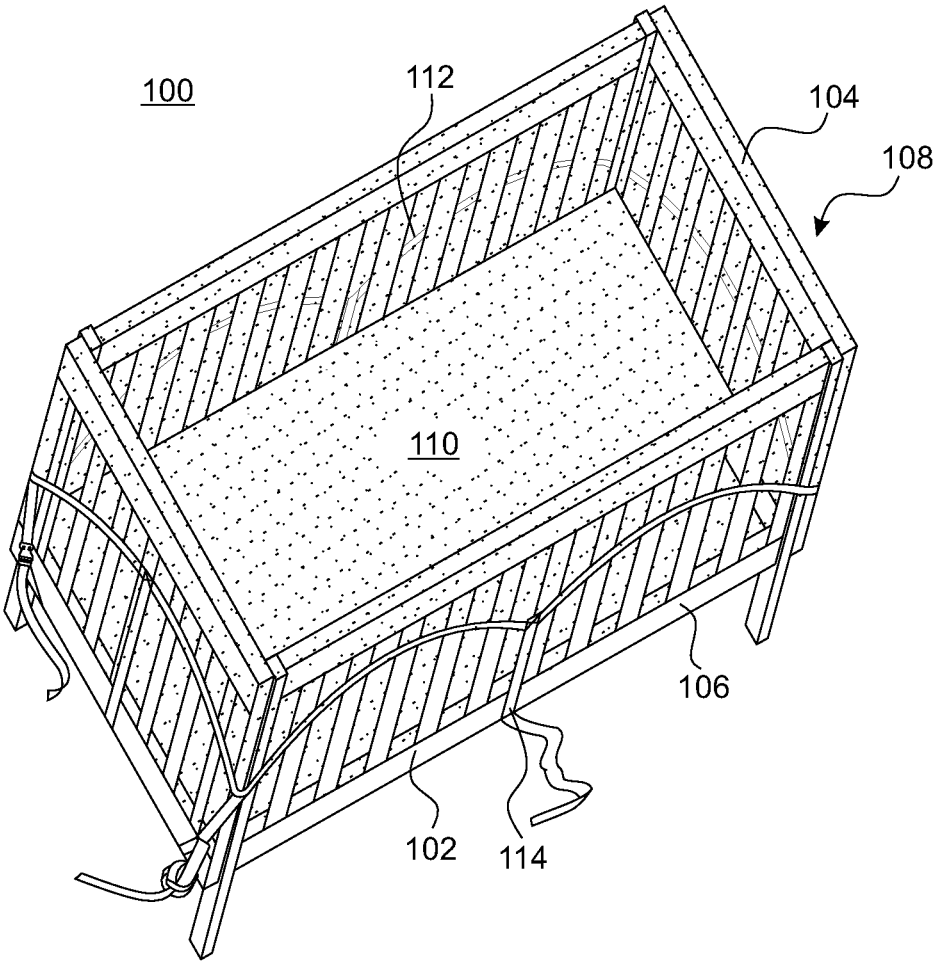
FIG. 1 shows a crib liner installed in a crib in accordance with an embodiment of the present disclosure.

The following embodiments are provided for illustrative purposes and should not be viewed as restrictive. Throughout the following detailed descriptions like structures and elements are identified by like reference numerals.

In some embodiments of the present disclosure, a breathable, stretchable material, formed as a crib liner, is disposed along an inside perimeter of a crib. The stretchable material can block an infant's legs and/or arms from being caught between adjacent crib slats. The stretchable material can be made breathable by having a micromesh construction, where the mesh openings are smaller than a width of a newborn child's finger, such that an infant will not be able to entangle a finger in the micromesh material. Using a breathable material prevents an infant from suffocating, should the infant roll over while sleeping so that the infant's face is pressed against the crib liner.

Referring to FIG. 1, a crib 100 is shown with an embodiment of a crib liner 108 is installed. The crib 100 includes a plurality of vertical slats 102 spaced at regular intervals along the perimeter of the crib 100. The crib liner 108 includes a bottom panel or layer 110 joined to side panel 112 that extends generally vertically from the bottom layer 110 (i.e., generally perpendicular from the bottom layer 110) to the top railings 104 of the crib 100. In some embodiments, the side panel 112 further extends over the top railing 104 and back down the exterior side of the crib 100 for at least a portion of the exterior sides of the crib 100. According to an aspect of the present disclosure, it will be appreciated that side panel 112 is continuous in construction and forms a closed circuit around bottom layer 110. By this construction, when applied to crib 100, side panel 112 is configured to form a closed circuit around the perimeter of crib 100.

Figure 2:
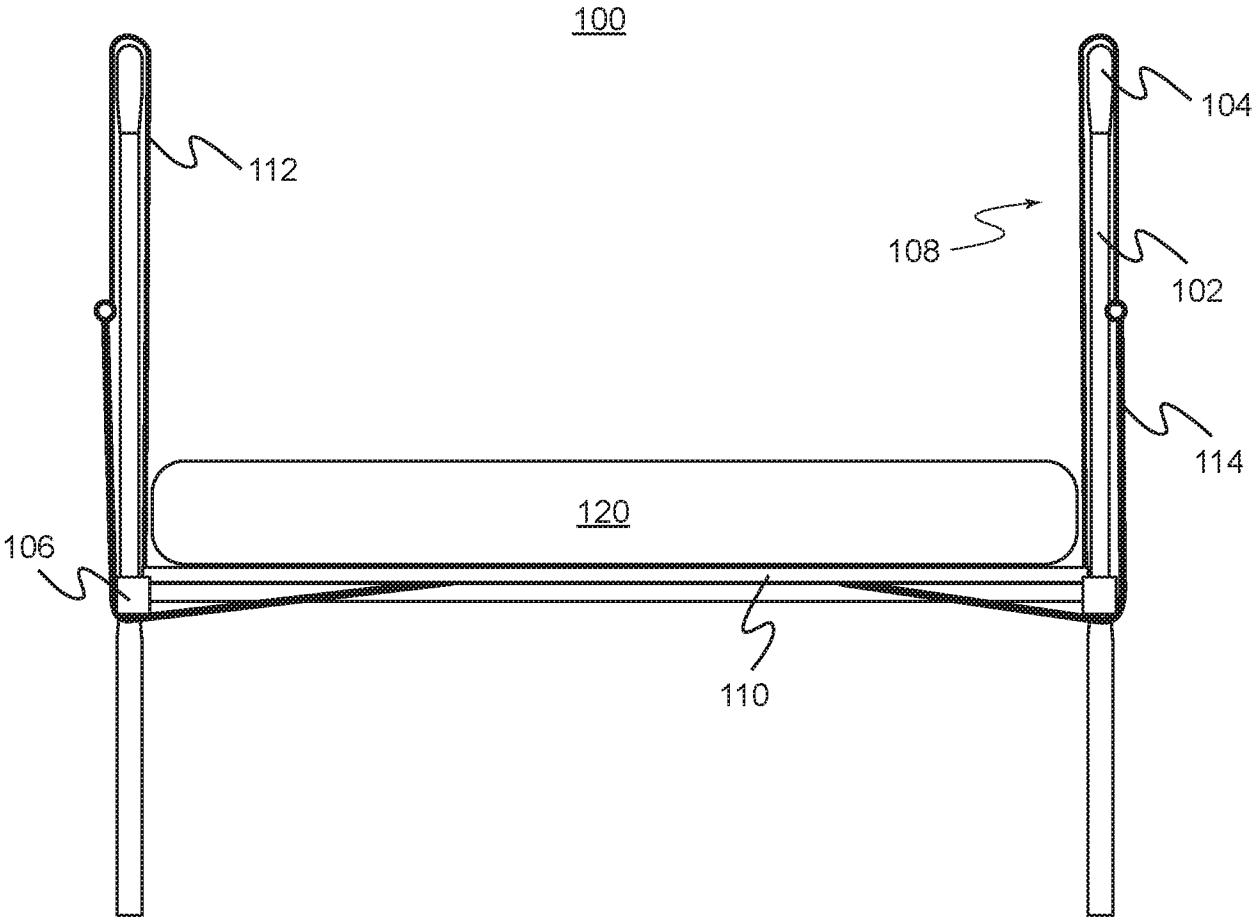
FIG. 2 shows a cross sectional view of a crib liner installed in a crib in accordance with an embodiment of the present disclosure.
Figure 5:
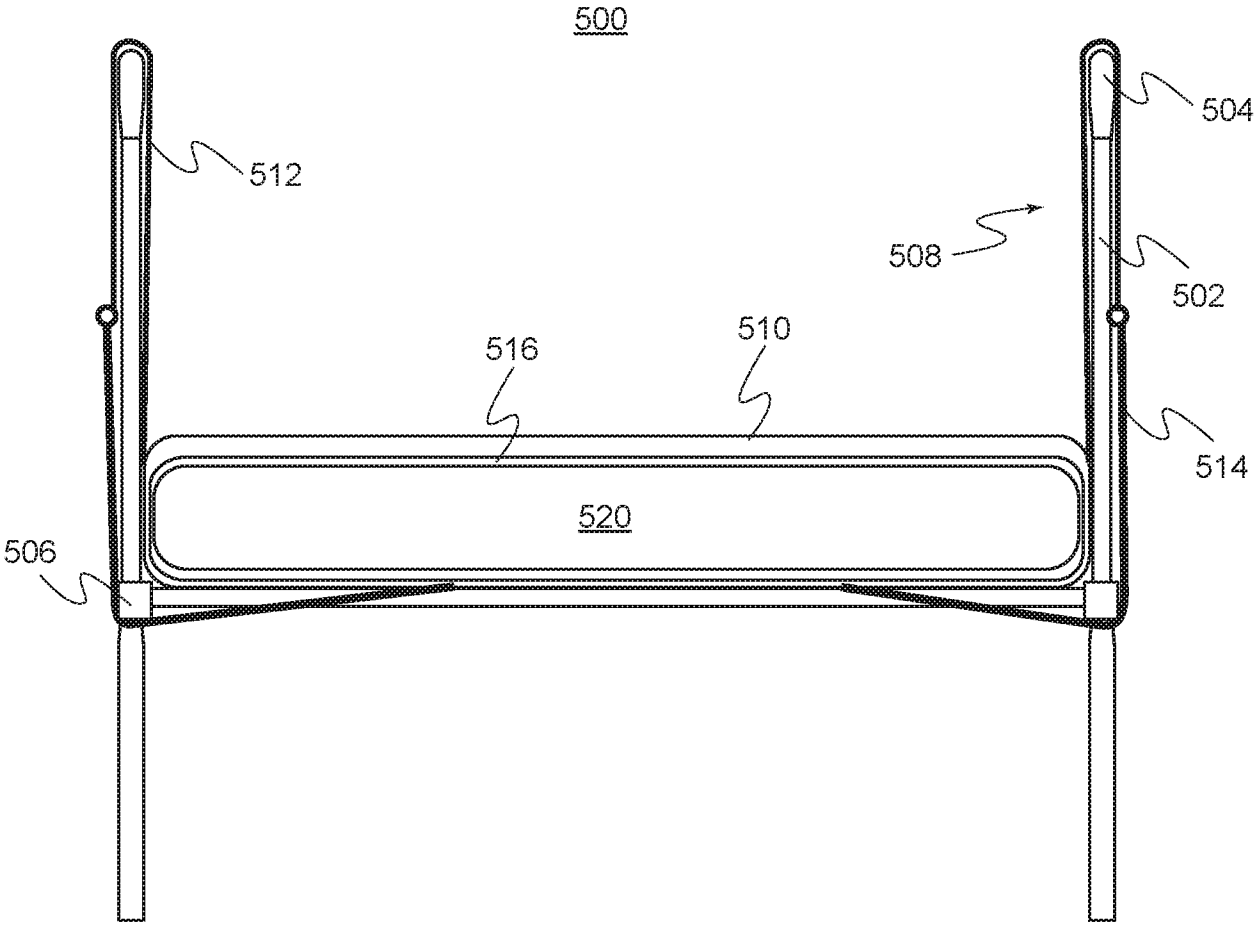
FIG. 5 shows a cross sectional view of a crib liner in a crib in accordance with another embodiment of the present disclosure.

In some embodiments, the bottom layer 110 is formed of a material, such as nylon, polyester, cotton, or combinations of these materials, for example. Additionally, in some embodiments, the bottom layer 110 can be configured as a ripstop fabric. In some embodiments, the bottom layer 110 is dimensioned to sit sandwiched between the interior bottom of the crib 100 and a mattress 120, as shown in FIG. 2 further described below. In other embodiments, the bottom layer can be formed with a pocket dimensioned to hold a mattress 520 therein, as shown in FIG. 5, and discussed below in greater detail.

The side panel 112, in some embodiments, can be a nylon micromesh fabric with an elastic property. The side panel 112, when constructed of an elastic material, can stretch to conform to the perimeter of the crib 100. In this way, wrinkles, sags and loose regions can be eliminated from the side panel 112 when it is properly installed on the crib 100.

Loose material can present an entanglement hazard to infants, and thus eliminating such occurrences can be desirable. As with the bottom layer 110, the side panel 112 can be constructed of a ripstop material as well.

In some embodiments, the free edge (top edge) of the side panel 112 can be finished with a reinforcing fabric that is sewn or otherwise bonded to the side panel 112. The reinforcing fabric can be selected from fabrics that can prevent tearing or fraying of the side panel 112. Additionally, in some embodiments, the reinforcing fabric can be an elastic material such that the elasticity of the side panel is not appreciably restricted.

In some embodiments, stays 114 (FIG. 2), in the form of poly webbing straps, for example, can be provided at each free corner of the side panel 112. The stays 114 are configured and dimensioned to extend from the respective corners of the side panel 112 to an anchor point (not shown) on the crib 100 such that the stays 114 hold the side panel taut and in place on the crib 100. In some embodiments, the stays 114 are attached to the side panel 112 using a box stitch onto the reinforcing fabric. Sewing the stays 114 to the reinforcing fabric allows for a more secure and substantial bonding between the stays 114 and the side panel 112.

In some embodiments, the stays 114 can be terminated with hooks configured to engage with a bottom railing 106 of the crib 100. In other embodiments, stays 114 can include hook and loop portions at terminal ends and configured to loop around the bottom railings 106 of the crib 100. In still other embodiments, the stays 114 can include insertion devices (e.g., male buckle devices) configured to engagingly insert into respective receiving devices (e.g., female buckle devices) disposed on an underside of the bottom layer 110. The receiving devices can be disposed at free ends of second stays attached to the underside of the bottom layer 110.

FIG. 2 shows a cross sectional view of an embodiment of the present disclosure. In FIG. 2, it should be noted that dimensions are not drawn to scale but may be exaggerated to provide clarity of the structure of the present embodiment. As shown, a mattress 120 is disposed on top of the bottom layer 110 when an embodiment of the crib liner 108 is in use. The stays 114 of the crib liner 108 in the present embodiment wrap around the lower railing 106 of the crib 100 and connect to the underside of the bottom layer 110. The underside of the bottom layer 110 is understood to be the side of the bottom layer 110 opposite the side in contact with the mattress 120.

Figure 3:
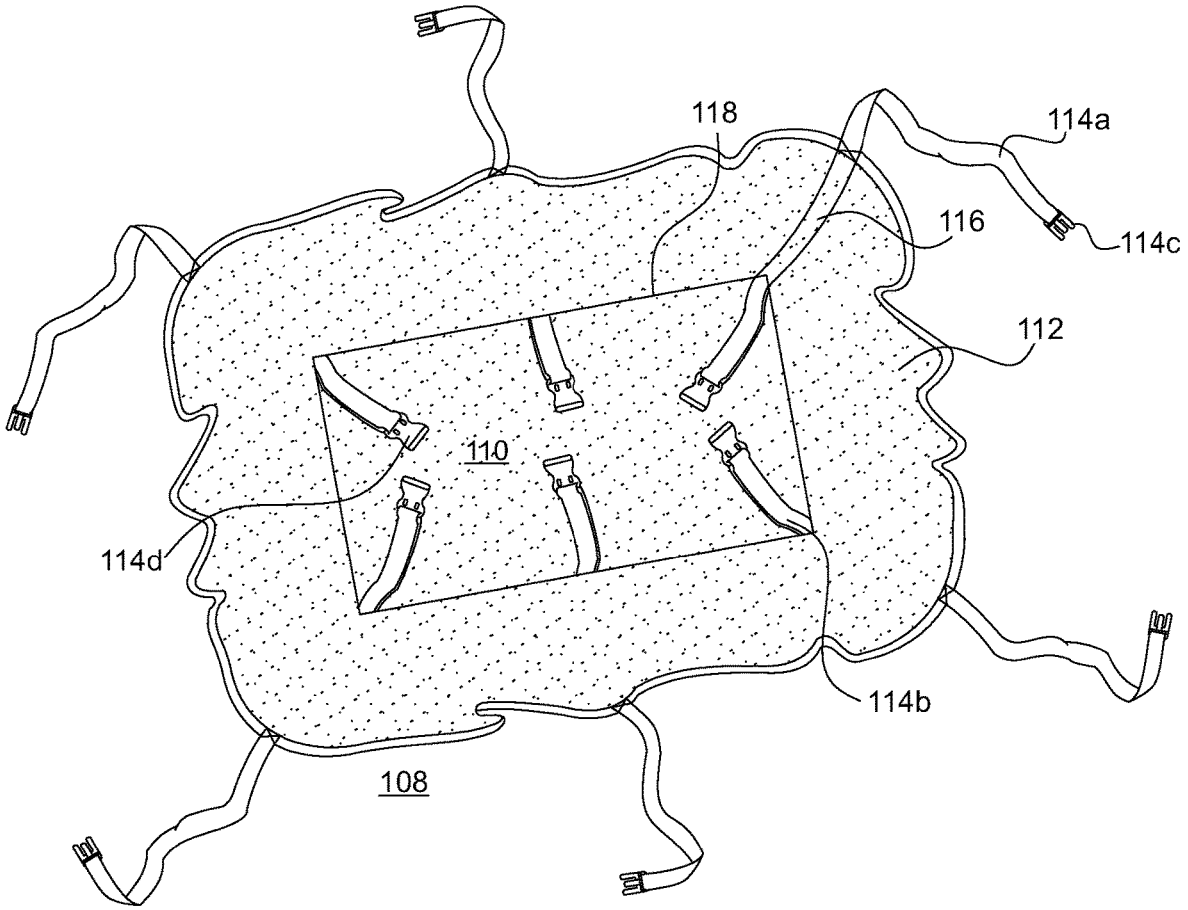
FIG. 3 shows a structural representation of a crib liner in accordance with an embodiment of the present disclosure.

FIG. 3 shows a bottom view of an embodiment of the crib liner 108. The crib liner 108 includes a plurality of stays 114*a* sewn along a free top edge of the side panel 112. The stays 114*a* can be distributed at intervals along the perimeter of the side panel 112. In other embodiments, the stays 114*a* can be attached at corners of the side panel 112 and at mid points along the sides. Each stay 114*a* has a corresponding stay 114*b* attached to the bottom layer 110. Thus, stay 114*a*, can be referenced as first stay 114*a*, while stay 114*b*, can be referenced as second stay 114*b*, hereinafter and collectively, as stays 114. By this construction, crib liner 108 provides for a six-point attachment on the exterior of the crib 100 as shown and described above with reference to FIGS. 2 and 3.

Each stay 114 terminates with an anchoring device 114*c* and 114*d*, such as center bar buckles, side release buckles, hook and loop, snaps, hooks, cam buckles, etc. The anchoring device 114*c* on the first stay 114*a* engages with the anchoring device 114*d* of a corresponding second stay 114*b*.

It will be appreciated that the stays 114*a*, 114*b* are strategically attached at intervals along the edge of the side panel 112 for holding the crib liner 108 in place relative to the crib 100. Furthermore, together with the corresponding anchoring devices 114*c*, 114*d*, stays 114*a*, 114*b* define anchoring points of the crib liner 108 configured to prevent any of the fabric material forming the crib liner 108 from extending into or entering the sleep environment within the crib 100. By this construction, infant injury in the crib 100 is substantially reduced.

In some embodiments, the bottom layer 110 is joined to the side panel using a stitching technique known as serge stitching. Serge stitching can be useful to prevent fraying of the fabrics used for the crib liner 100. However, in other embodiments alternative stitching techniques can be used as well. Additionally, in some embodiments the crib liner 100 can be constructed from a single unitary piece of fabric that is folded and stitched to form the desired shape and size.

Figure 4:
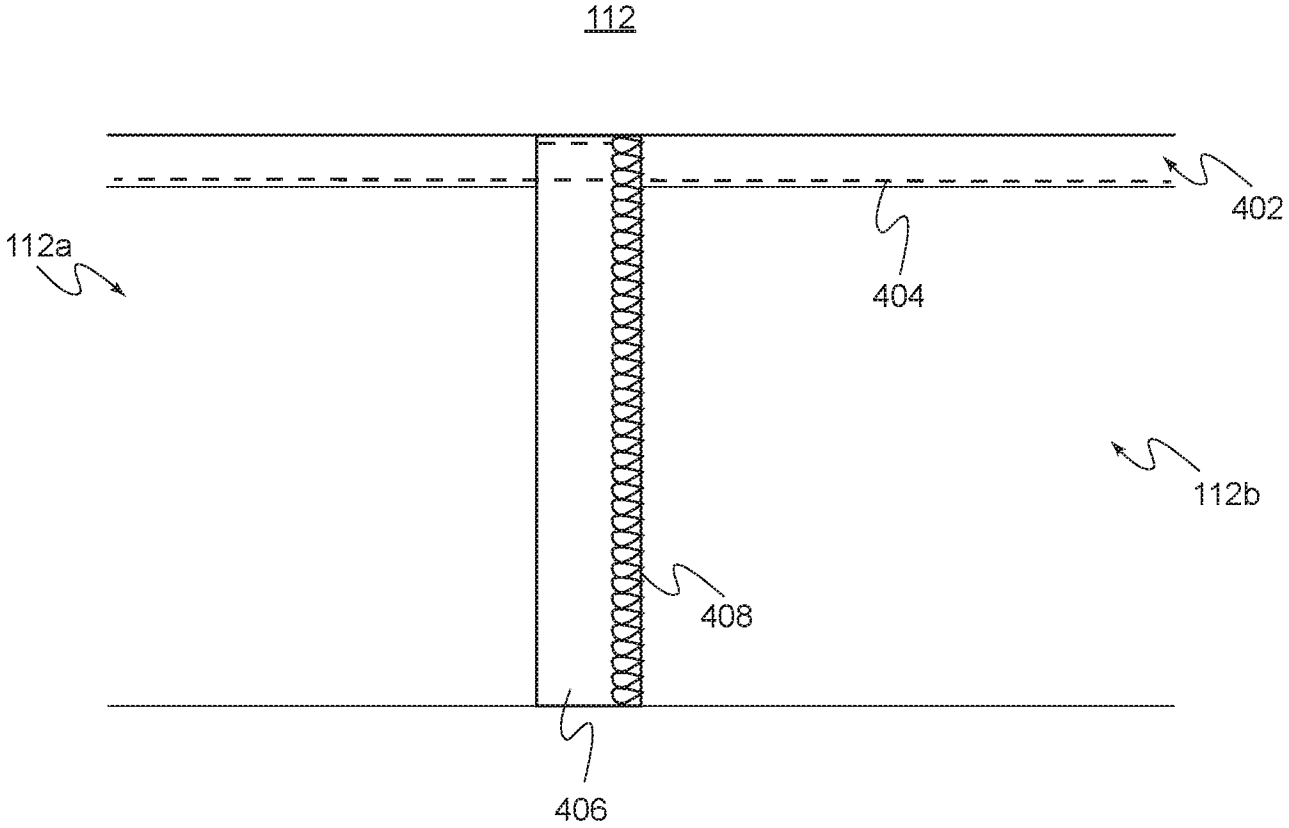
FIG. 4 shows an enlarged view of a seam in accordance with an embodiment of the present disclosure.

Turning to FIG. 4, an enlarged view of a region of the side panel 112 in which two opposing ends of the side panel 112 are joined to form a closed loop. A reinforcing fabric 402 is joined to a top edge of the side panel 112 using, for example stitching 404. To form the closed loop, a first end 112*a* of the side panel 112 is joined to a second end 112*b* of the side panel 112 using, for example, a serge stitch 408 to form a flat lock seam. Additionally, in some embodiments, the seam joining the first end 112*a* and the second end 112*b* can include a spandex bias tape 406, which can provide further reinforcement of the seam.

Referring to FIG. 5, a crib 500 is shown with an embodiment of a crib liner 508 being installed. The crib 500 includes a plurality of vertical slats 502 spaced at regular intervals along the perimeter of the crib 500. The crib liner 508 includes a bottom layer 510 joined to side panel 512 that extends vertically from the bottom layer 510 (i.e., generally perpendicular from the bottom layer 510) to the top railings 504 of the crib 500. In some embodiments, the side panel 512 further extends over the top railing 504 and back down the exterior side of the crib 500 for at least a portion of the exterior sides of the crib 500. According to an aspect of the present disclosure, it will be appreciated that side panel 512 is continuous in construction and forms a closed circuit around bottom layer 510. By this construction, when applied to crib 500, side panel 512 is configured to form a closed circuit around the perimeter of crib 500.

In the embodiment shown in FIG. 5, the bottom layer 510 can be constructed to form a pocket 516 that is dimensioned to receive and hold a mattress 520. In this embodiment, the bottom layer 510 can be used to replace a fitted sheet that would normally be used to cover the mattress surface. In some embodiments, the bottom layer 510 is formed of a fabric such as nylon, polyester, cotton, or combinations of these materials, for example. Additionally, in some embodiments, the bottom layer 510 can be configured as a ripstop fabric. Also, in some embodiments, the top of the pocket 516 can be made water resistant, thus protecting the mattress 520 held in the pocket 516 from damage and staining in the case of diaper leakage while an infant is sleeping in the crib.

The side panel 512, in some embodiments, can be a nylon micromesh fabric with an elastic property. The side panel 512, when constructed of an elastic material, can stretch to conform to the perimeter of the crib 500. In this way, wrinkles, sags and loose regions can be eliminated from the side panel 512 when it is properly installed on the crib 100. Loose material can present an entanglement hazard to infants, and thus eliminating such occurrences can be desirable. As with the bottom layer 510, the side panel 512 can be constructed of a ripstop material as well.

In the present embodiment, the side panel 512 can be sewn along the side of the bottom layer 510 at, or near the top surface of the bottom layer 510. By sewing the side panel 512 near the top surface of the bottom layer 510, the side panel 512 can also prevent an infant from accidentally entrapping a limb between the mattress 520 and the vertical slats 502, or under the mattress 520 entirely.

In some embodiments, the free edge (top edge) of the side panel 512 can be finished with a reinforcing fabric that is sewn or otherwise bonded to the side panel 512. The reinforcing fabric can be selected from fabrics that can prevent tearing or fraying of the side panel 512. Additionally, in some embodiments, the reinforcing fabric can be an elastic material such that the elasticity of the side panel is not appreciably restricted.

In some embodiments, stays 514, in the form of poly webbing straps, for example, can be provided at each free corner of the side panel 512. The stays 514 are configured and dimensioned to extend from the respective corners of the side panel 512 to an anchor point (not shown) on the crib 500 such that the stays 514 hold the side panel taut and in place on the crib 500. In some embodiments, the stays 514 are attached to the side panel 512 using a box stitch onto the reinforcing fabric. Sewing the stays 514 to the reinforcing fabric allows for a more secure and substantial bonding between the stays 514 and the side panel 512.

In some embodiments, the stays 514 can be terminated with hooks configured to engage with a bottom railing 506 of the crib 500. In other embodiments, the stays can include hook and loop portions at terminal ends and configured to loop around the bottom railings 506 of the crib 500. In still other embodiments, the stays 514 can include insertion devices (e.g., male buckle devices) configured to engagingly insert into respective receiving devices (e.g., female buckle devices) disposed on an underside of the bottom layer 510. The receiving devices can be disposed at free ends of second stays attached to the underside of the bottom layer 510.

The stays 514 of the crib liner 508 in the present embodiment wrap around the lower railing 506 of the crib 500 and connect to the underside of the bottom layer 510. The underside of the bottom layer 510 is understood to be the side of the bottom layer 510 opposite the side in contact with the mattress 520. Similar to crib liner 108 described above with reference to FIGS. 1-4, crib liner 508 provides for a six-point attachment on the exterior of the crib 100.

It will be appreciated that in an exemplary aspect of the present disclosure, all components of the embodiments of the crib liners 108 and 508 described above are substantially non-elastic in construction, except for the corresponding side panels 112 and 512. This aspect of the present disclosure facilitates adjustment of crib liners 108 and 508 to cribs of different configurations and/or dimensions. Thus, the crib liners of the present disclosure feature ease of installation and universal fit.

Figure 6:
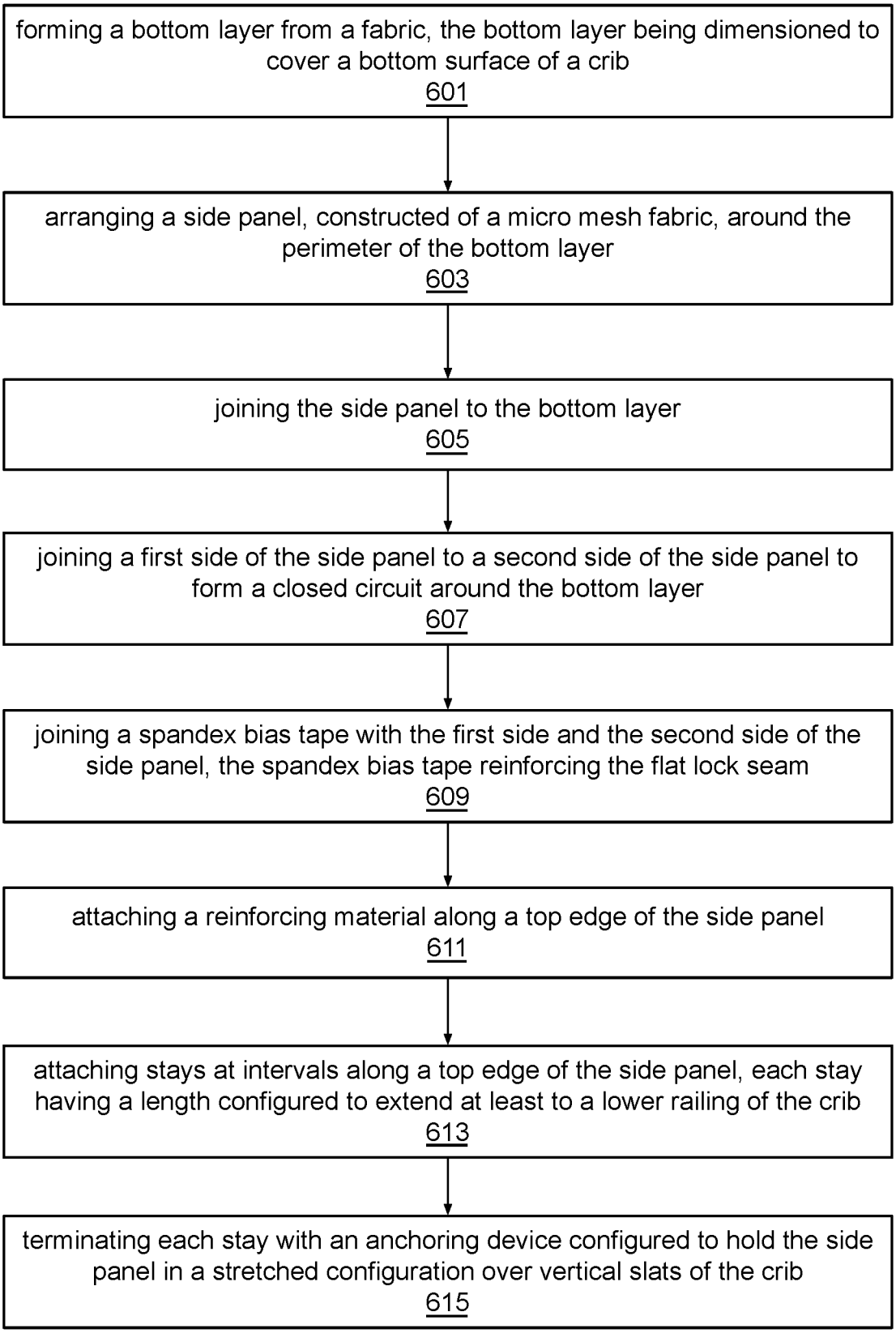
FIG. 6 shows a representation of a method for fabricating a crib liner in accordance with an embodiment of the present disclosure.

A method for fabricating a crib liner, such as crib liner 108 shown in FIG. 1, for example, in accordance with an embodiment is shown in FIG. 6. The crib liner 108 can be fabricated by forming a bottom layer 110 from a fabric, such as a ripstop fabric at block 601. A side panel 112 is arranged around the perimeter of the bottom layer 110 at block 603. The side panel 112 can be constructed of a micro mesh fabric. At block 605, the side panel 112 is joined to the bottom layer 110 using, for example, a serge stitch.

At block 607, two ends of the side panel 112, e.g., a first side and a second side opposite the first side, are joined to form a closed circuit around the bottom layer 110. Stated otherwise, the side panel 112 is continuous in construction. The joining of the first side and a second side of the side panel 112 can form a flat lock seam. A spandex bias tape, such as the spandex bias tape 406 shown in FIG. 4, is joined, with the first side and the second side of the side panel 112 using a serge stitch. The spandex bias tape provides reinforcement to the flat lock seam.

At block 611 a reinforcing material, such as the reinforcing material 402 shown in FIG. 4, is attached along a top edge of the side panel 112. Stays 114 are attached, at block 613, to the top edge of the side panel 112. Each stay has a length configured to extend at least to a lower railing of a crib. At block 615, each stay is terminated with an anchor device configured to hold the side panel in a stretched configuration over vertical slats of the crib.

The foregoing is to be understood as being in every respect illustrative and exemplary, but not restrictive, and the scope of the disclosure disclosed herein is not to be determined from the Detailed Description, but rather from the claims as interpreted according to the full breadth permitted by the patent laws. It is to be understood that the embodiments shown and described herein are only illustrative of the present disclosure and that those skilled in the art may implement various modifications without departing from the scope and spirit of the disclosure. Those skilled in the art could implement various other feature combinations without departing from the scope and spirit of the disclosure. Having thus described aspects of the disclosure, with the details and particularity required by the patent laws, what is claimed and desired protected by Letters Patent is set forth in the appended claims.

What is claimed is:

1. A crib liner for a crib having a support frame for supporting a mattress and a railing extending from the support frame, the crib liner comprising:

a bottom layer made of a substantially non-elastic material, the bottom layer being configured to be positioned between the support frame and the mattress and to completely cover a surface of the support frame that supports the mattress;

a side panel formed of a breathable elastic material extending generally perpendicular from the bottom layer, the side panel being continuous in construction such that it forms a closed circuit around the bottom layer and is configured to form a closed circuit around the perimeter of the crib and extend beyond the top surface of the crib railing; and a plurality of first and second stays each made of a substantially non-elastic material, the first stays being attached at intervals along an outer edge of the side panel and the second stays being attached to the bottom layer, the first stays being configured to wrap around the crib railing and connect to the respective second stays for holding the crib liner in place relative to the crib, the first and second stays defining anchoring points for the crib liner configured to hold the crib liner in place relative to the crib while preventing any of the material forming the crib liner from extending into or entering the sleep environment within the crib.

2. The crib liner as in claim 1, wherein the side panel has an inner edge defining an aperture within the side panel; and wherein the bottom layer is affixed to the side panel at the inner edge so as to completely cover the aperture within the side panel.

3. The crib liner as in claim 1, wherein the side panel is formed of a combination of nylon and spandex micromesh materials.

4. The crib liner as in claim 1, wherein side panel is joined to the bottom layer using a serge stitch.

5. The crib liner as in claim 1, wherein the side panel is constructed of a length of fabric having opposing ends joined to one another, in combination with a spandex bias tape, using a serge stitch to form a flat lock seam.

6. The crib liner as in claim 1, wherein the bottom layer includes a pocket dimensioned to receive and hold the mattress therein, and the side panels are joined to the bottom layer at a position proximate to a top surface of the bottom layer.

7. A crib liner for a crib having a support frame for supporting a mattress and a railing extending from the support frame, the crib liner comprising:

a side panel configured to form a closed circuit around a perimeter of the crib and to extend beyond a top surface of the crib railing, the side panel having an outer edge and an inner edge spaced from the outer edge and defining an aperture within the side panel;

a bottom layer configured to be positioned between the support frame of the crib and the mattress, the bottom layer being affixed to the side panel at the inner edge so as to completely cover the aperture within the side panel; and a plurality of first and second stays defining anchoring points for the crib liner configured to hold the crib liner in place relative to the crib, the first stays being attached at intervals along the outer edge of the side panel and the second stays being attached to the bottom layer, and the first stays being configured to wrap around the crib railing and connect to the respective second stays for holding the crib liner in place relative to the crib.

8. The crib liner as in claim 7, wherein the bottom layer and side panel are constructed of a ripstop fabric material.

9. The crib liner as in claim 7, wherein the side panel is constructed of a length of fabric having opposing ends joined to one another, in combination with a spandex bias tape, using a serge stitch to form a flat lock seam.

10. The crib liner as in claim 7, wherein side panel is joined to the bottom layer using a serge stitch.

11. The crib liner as in claim 7, wherein the first and second stays comprise respective male and female buckle devices at free ends thereof for connection to one another.

12. The crib liner as in claim 7, wherein the bottom layer and the first and second stays are formed of a substantially non-elastic material, and the side panel is formed of a breathable, elastic material.

* * * * *